US006535179B1

(12) United States Patent
Petros

(10) Patent No.: US 6,535,179 B1
(45) Date of Patent: Mar. 18, 2003

(54) DROOPING HELIX ANTENNA

(75) Inventor: Argy Petros, Lake Worth, FL (US)

(73) Assignee: XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 09/968,821

(22) Filed: Oct. 2, 2001

(51) Int. Cl.[7] ..... H01Q 1/36
(52) U.S. Cl. ..... 343/895
(58) Field of Search ..... 343/895, 853, 343/700 MS

(56) References Cited

U.S. PATENT DOCUMENTS

| | | | | |
|---|---|---|---|---|
| 4,062,019 A | * | 12/1977 | Woodward et al. | 343/797 |
| 4,114,164 A | | 9/1978 | Greiser | 343/895 |
| 4,349,824 A | | 9/1982 | Harris | 343/700 MS |
| 5,134,422 A | | 7/1992 | Auriol | 343/895 |
| 5,170,176 A | | 12/1992 | Yasunaga et al. | 343/895 |
| 5,198,831 A | | 3/1993 | Burrell et al. | 343/895 |
| 5,255,005 A | | 10/1993 | Terret et al. | 343/895 |
| 5,349,365 A | | 9/1994 | Ow et al. | 343/895 |
| 5,541,617 A | | 7/1996 | Connolly et al. | 343/895 |
| 5,838,285 A | * | 11/1998 | Tay et al. | 343/700 MS |
| 5,986,620 A | | 11/1999 | Filipovic | 343/895 |
| 6,211,840 B1 | * | 4/2001 | Wood et al. | 343/793 |
| 6,229,499 B1 | * | 5/2001 | Licul et al. | 343/895 |
| 6,421,029 B1 | * | 7/2002 | Tanabe | 343/700 MS |

FOREIGN PATENT DOCUMENTS

| | | |
|---|---|---|
| EP | 0 320 404 | 6/1989 |

* cited by examiner

*Primary Examiner*—Tan Ho
(74) *Attorney, Agent, or Firm*—Akerman Senterfitt

(57) ABSTRACT

A drooping quadrifilar helix antenna includes first, second, third, and fourth radiating elements (42, 44, 46, and 48 respectively) of conductive material, each element extending in a first direction in a first plane and at least one of the radiating elements having a portion (47) thereof drooping in a second direction in a second plane, the antenna further including a dielectric tube (45) for maintaining a substantial portion of the radiating elements in a substantially helical or spiral shape, a coupler (24) for coupling electrical energy to and/or from each of said radiating elements, and a feed network (22) for individually feeding at least two of the radiating elements.

20 Claims, 3 Drawing Sheets

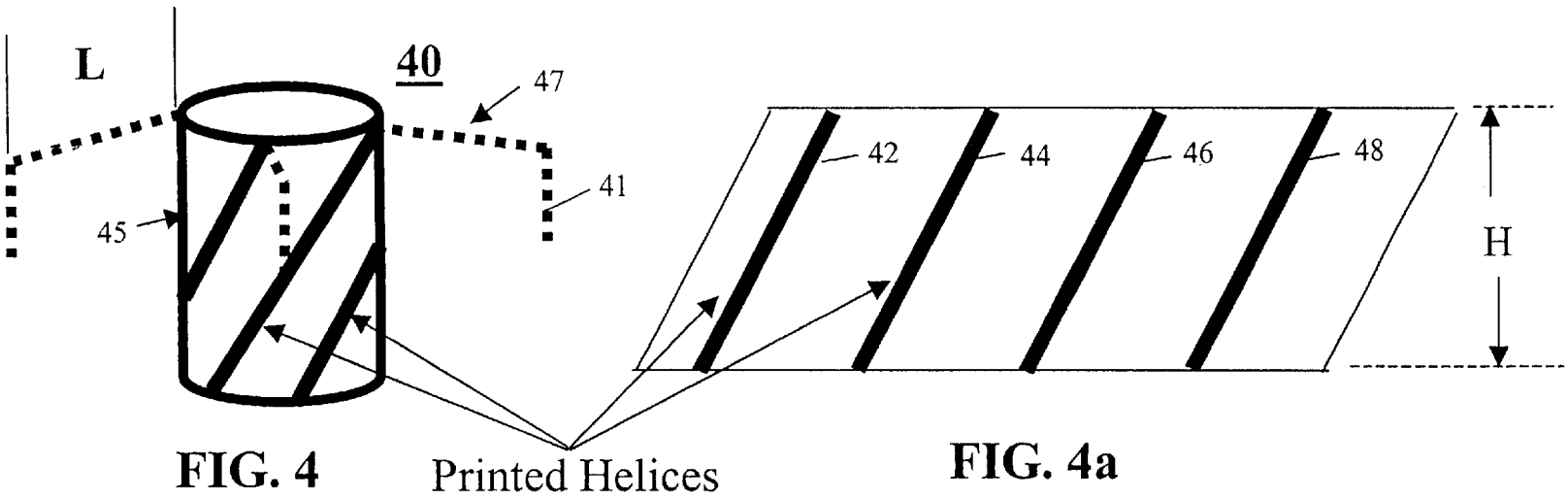
FIG. 4a
FIG. 4
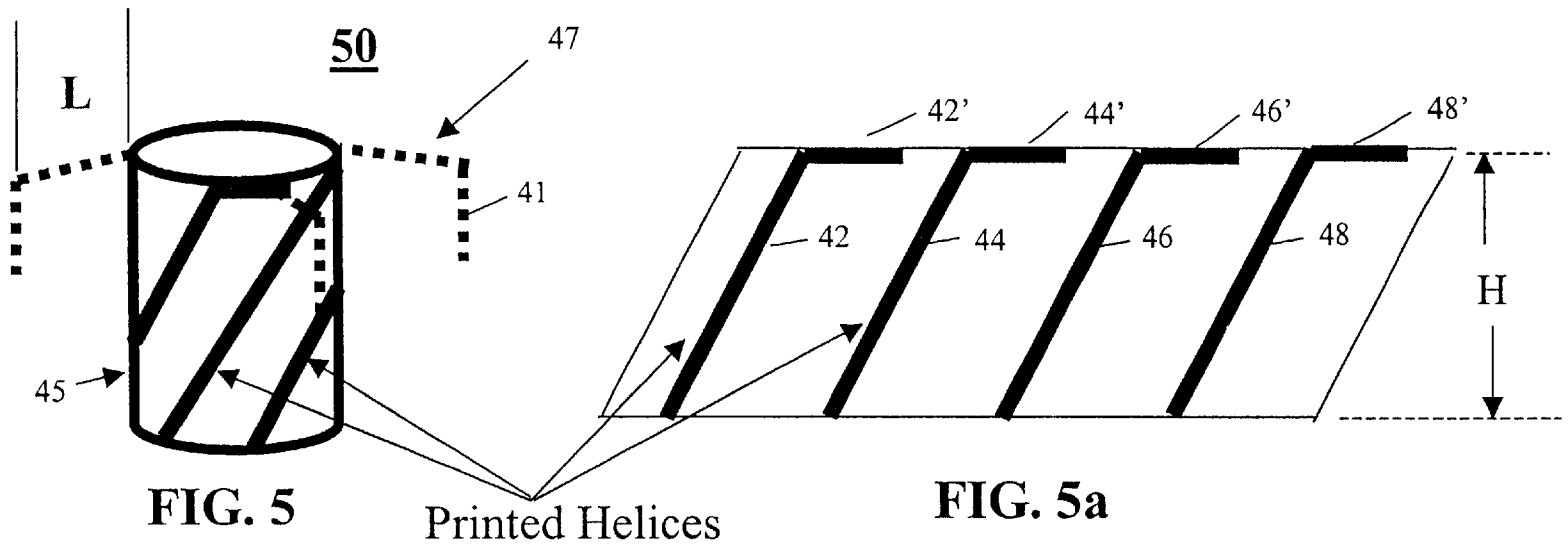
FIG. 5a
FIG. 5

DROOPING HELIX ANTENNA

CROSS-REFERENCE TO RELATED APPLICATIONS (not applicable)

FIELD OF THE INVENTION

The invention relates generally to antennas, and more particularly to a drooping helix antenna able to provide excellent performance in a low profile configuration.

BACKGROUND OF THE INVENTION

Helical antennas are well known in the art. See for example U.S. Pat. No. 5,541,617 issued Jul. 30, 1996, to Connolly et al.; U.S. Pat. No. 5,349,365 issued Sep. 20, 1994 to Ow et al.; U.S. Pat. No. 5,134,422 issued Jul. 28, 1992 to Auriol; U.S. Pat. No. 4,349,824 issued Sep. 14, 1982 to Harris; U.S. Pat. No. 5,255,005 issued Oct. 19, 1993 to Terret et al.; U.S. Pat. No. 5,170,176 issued Dec. 8, 1992 to Yasunaga et al.; and U.S. Pat. No. 5,198,831 issued Mar. 30, 1993 to Burrell et al., the teachings of which are hereby incorporated herein by reference. See also "A Shape-Beam Antenna For Satellite Data Communication" published Oct. 12, 1976, by Randolph W. Bricker, Jr. AP-S Session 4, 1630, at the AP-S. International Symposium held in 1976 in Amherst, Mass., U.S.A., pp. 121–126. Drooping dipole antennas are also fairly well known as shown in U.S. Pat. No. 6,211,840, issued Apr. 3, 2001, to Wood et al and U.S. Pat. No. 4,686,536, issued August 1987, to Allcock, the teachings of which are hereby incorporated herein by reference.

As noted by Auriol, helical antennas offer the advantage of radiating an electromagnetic wave in a high-quality circular polarization state over a wide coverage area with a transmission lobe that may be shaped as needed for a given. application. These characteristics make helical antennas valuable in various fields of use, such as ground links with orbiting satellites or mobile/relay ground links with geosynchronous satellites.

Popular receiving helical antennas are typically either bifilar with two helices spaced equally and circumferentially on a cylinder or quadrifilar with four helices arranged the same way. Because of the radiation or coverage pattern thereof, quadrifilar helix antennas are typically well suited for mobile-to-satellite communication applications. As discussed in Antenna Engineering Handbook by Richard C. Johnson and Henry Jasik, pp. 13–19 through 13–21 (1984), a quadrifilar helix (or volute) antenna is a circularly polarized antenna having four orthogonal fractional-turn (one fourth to one turn) helixes excited in phase quadrature. Each helix is balun-fed at the top (although the helices can also be fed at the bottom) with four helical arms of wires or metallic strips of resonant lengths (l=.lambda./4, m=1, 2, 3, . . . ) wound on a small diameter with a large pitch angle. This antenna is a fairly well suited for various applications requiring a wide hemispherical or cardioid shaped radiation pattern. In addition, quadrifilar helix antennas generally offer a high bandwidth as compared to patch antennas over the high frequency ranges required for satellite communication (e.g., GPS) applications.

Recently, a need has been recognized for an antenna suitable for use in mobile satellite radio applications. For the reasons set forth above, the quadrifilar helix antenna is a prime candidate. One of the advantages of the quadrifilar antenna is its compact size and relatively small diameter. For the satellite radio application, the height of the antenna must conform to size and space constraints for a target environment (e.g. automobile installation). Unfortunately, as is well known in the art, the height of a quadrifilar helix antenna is directly related to its impedance. Consequently, any change in the height of the antenna will affect its impedance and its performance. Hence, changes in height of conventional quadrifilar helix antennas typically require a redesign of the impedance matching circuit associated therewith.

In addition, changes in the height of conventional quadrifilar helix antennas are limited in that the height of the antenna, that is, the length of the radiating elements, must be a discrete integer multiple of one quarter-wavelength (.lambda./4) of the operating frequency of antenna. Further such reductions in the height of conventional quadrifilar helix antennas are achieved, generally, at the cost of reduced gain.

In U.S. Pat. No. 6,229,499 issued May 8, 2001 to Licul, et al., assigned to the assignee of the present invention and incorporated herein by reference, a folded helical antenna is discussed offering the advantage of a low profile configuration and overcoming many of the detriments discussed above. As much as 20% height reduction can be achieved using such technique without degradation on antenna efficiency. Still, however, other alternative methods are needed that result in even lower-profile antennas (for example, 40 mm or less) to that provide adequate performance in a demanding target consumer market.

SUMMARY

In a first aspect of the present invention, a drooping helix antenna comprises at least first and second radiating elements of conductive material, each element extending in a first direction in a first plane and having a portion thereof drooping in at least a second direction in a second plane. The drooping helix antenna further comprises means for individually feeding at least two of said elements and a means for maintaining said radiating elements in a substantially helical or spiral shape except for said drooping portion.

In a second aspect of the present invention, a drooping quadrifilar helix antenna comprises first, second, third, and fourth radiating elements of conductive material, each element extending in a first direction in a first plane and at least one of the radiating elements having a portion thereof drooping in a second direction in all, a second plane. The drooping quadrifilar helix antenna further comprises a dielectric tube for maintaining a substantial portion of said radiating elements in a substantially helical or spiral shape and a coupler for coupling electrical energy to and/or from each of said radiating elements, wherein said coupler includes a feed network for individually feeding at least two of said elements.

In a third aspect of the present invention, a drooping helix antenna, comprises a plurality of radiating elements each formed in a substantially parallel helical of spiral configuration, and a plurality of drooping elements (which also radiate) appended to a corresponding member of the plurality of radiating elements wherein at least a portion of each of the plurality of drooping elements are in substantial perpendicular relation to the corresponding member of the plurality of radiating elements.

BRIEF DESCRIPTION OF THE DRAWINGS

FIG. 4 is a diagram that illustrates the radiating elements of a quadrifilar drooping helix antenna having separate drooping members in accordance with the present invention.

FIG. 4*a* is a diagram which illustrates the radiating elements of the quadrifilar drooping helix antenna of FIG. 4 having a portion the radiating elements on a thin flexible substrate and separate portion in the form of separate drooping members in accordance with the present invention.

FIG. 5 is a diagram that illustrates radiating elements of a quadrifilar drooping helix antenna having substantially perpendicular portions to the radiating elements and further having separate drooping members in accordance with the present invention.

FIG. 5*a* is a diagram which illustrates the radiating elements of the quadrifilar drooping helix antenna of FIG. 5 having a portion the radiating elements (including the substantially perpendicular portions) on a thin flexible substrate and a separate portion in the form of separate drooping members in accordance with the present invention.

DETAILED DESCRIPTION OF THE DRAWINGS

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
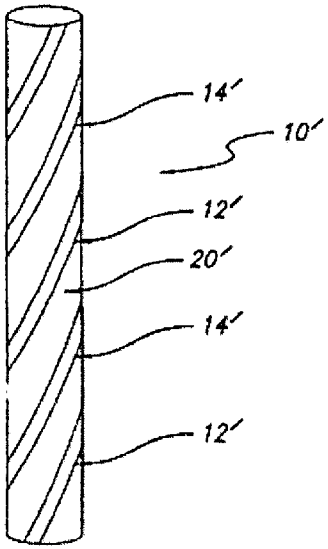
FIG. 1 PRIOR ART
FIG. 1 is a front elevation a view of a typical conventional implementation of a quadrifilar helix antenna in accordance with the teachings of the prior art.

FIG. 1 is a front elevation a view of a typical conventional implementation of a quadrifilar helix antenna in accordance with the teachings of the prior art. As shown in FIG. 1, the antenna 10' includes four radiating elements of which two are shown 12' and 14' mounted or etched on a plastic dielectric tube or flexible substrate 20'. The tube obscures the remaining two radiating elements. The dielectric tube 20' may be constructed of Ultem or other suitable low loss material e.g., Lexan or urethane, or thin laminate.

In the design of a conventional quadrifilar helix antenna, such as that shown in FIG. 1, to achieve a desired radiation pattern in accordance with conventional teachings, one needs to consider three important physical parameters: pitch, diameter, and height. Each of these parameters can drastically change the radiation properties and impedance of the antenna.

Before building the antenna, several simulations are typically performed in order to determine the dimensions appropriate for given application. After the correct diameter, pitch, and height are determined, one is generally ready to build the antenna. There is a potential problem, however. Building the antenna according to the dimensions provided by simulation does not usually guarantee a desired impedance, i.e., 50 ohms. To match the antenna to the required impedance, one skilled in conventional teachings would normally clip the antenna elements. Unfortunately, this causes a height reduction, which in turn may yield an undesirable radiation pattern and reduction in gain.

Figure 2:
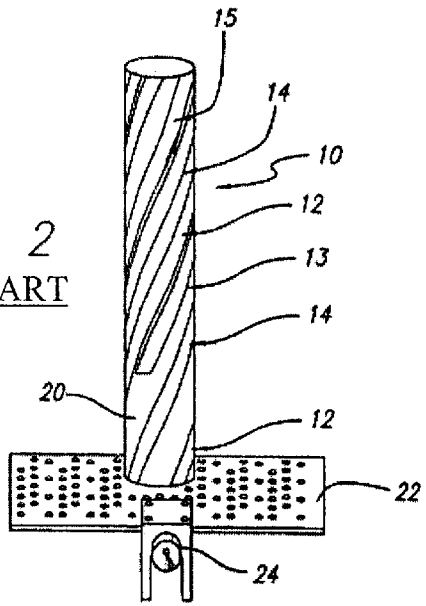
FIG. 2 PRIOR ART
FIG. 2 is a front elevation view of a quadrifilar helix antenna having folded members and constructed in accordance with the teachings of the prior art.
Figure 2A:
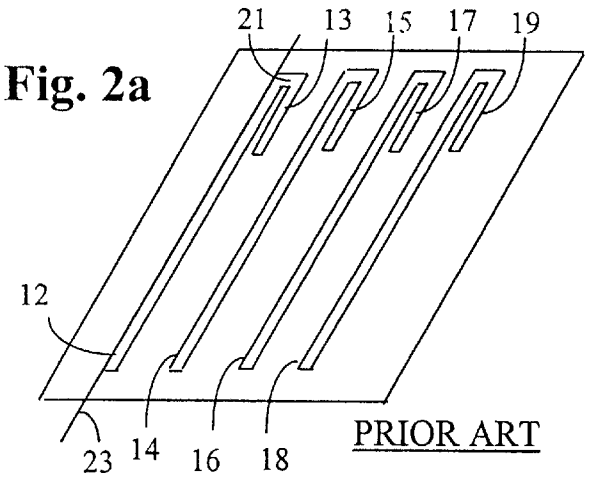
Fig. 2a PRIOR ART
FIG. 2*a* is a diagram which illustrates the radiating elements of the quadrifilar helix antenna of FIG. 2 having folded members, etched on a thin flexible substrate.
Figure 1A:
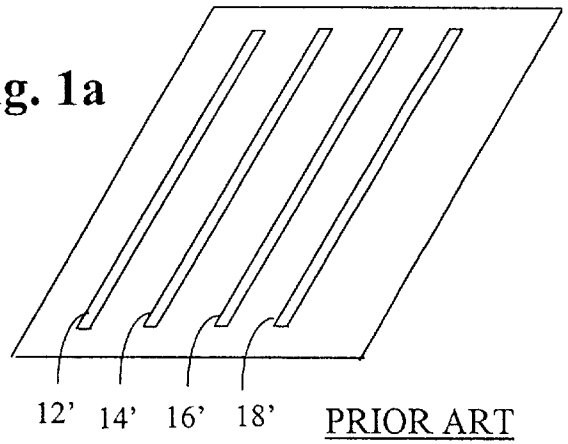
Fig. 1a PRIOR ART
FIG. 1*a* is a diagram that illustrates the radiating elements of the typical conventional quadrifilar helix antenna of FIG. 1, etched on a thin flexible substrate.

FIG. 2 is a front elevation a view of a quadrifilar helix antenna constructed in accordance with the U.S. Pat. No. 6,229,499. As shown in FIG. 2, the antenna 10 includes four helical radiating elements of which two are shown 12 and 14 mounted on a feed network 22. The antenna 10 is similar to the antenna 10' of FIG. 1 with the exception that each radiating element has some portion thereof which is folded into substantially parallel relation with the longitudinal axis of the radiating element. FIG. 2 shows for example the first radiating element 12 having a portion 13 thereof which is folded. Likewise, element 14, has a portion 15 which is folded. The manner of folding the radiating elements is best illustrated and FIGS. 1*a* and 2*a* below. FIG. 1*a* is a diagram which illustrates the radiating elements of the typical conventional quadrifilar helix antenna 10' of FIG. 1, etched on a thin flexible substrate. FIG. 2*a* is a diagram which illustrates the radiating elements of the quadrifilar helix antenna 10 of FIG. 2 etched on a thin flexible substrate. As shown in FIG. 2*a*, each element 12, 14, 16, and 18 of the antenna 10 has a corresponding portion 13, 15, 17, and 19, respectively, which is folded into parallel relation with the corresponding radiating element. Element 12 for example has a portion 13 which is folded into parallel relation with the longitudinal axis 23 thereof. Each folded portion is connected to the main portion of the corresponding radiating element by a short segment 21. As mentioned before, through this folding technique, height reductions of as much as 20% can be achieved. Further reduction may result in performance degradation. In some applications, even more drastic reduction is required without degrading antenna performance. For example, in some automotive applications the antenna is located on the vehicle roof. A technique that achieves significant height reductions without performance degradation is illustrated in FIGS. 4 and 5, where two embodiments are shown are shown in accordance with the present invention.

Figure 3:
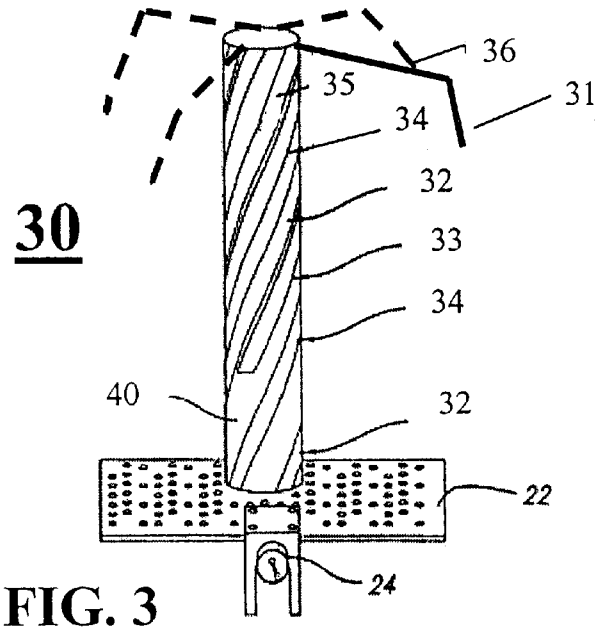
FIG. 3 is a front elevation view of the quadrifilar drooping helix antenna having folded radiating members and drooping radiating member in accordance with the present invention.

As shown in FIG. 3 (and may become further apparent with the discussion if FIGS. 4 and 5), each element 32, 34, (and others not shown) of an antenna 30 has a corresponding drooping portion that may comprise a first drooping portion 36 and a second drooping portion 31. In addition, the embodiment of FIG. 3 also includes folded portions 33, 35, (and others not shown) corresponding to the elements 32 and 34 (and the unseen elements), respectively, which is folded into parallel relation with the corresponding radiating element. The drooping portions gives an antenna designer added choice in implementing a suitable low profile helix antenna. If four radiating elements are used as shown, the drooping portions should preferably be arranged and constructed to be in substantially 90 degrees phase from each adjoining "drooping" branch. The antenna 30 also preferably comprises a feed network 22 and a coupler 24 as shown.

FIGS. 4*a* and 5*a* are representative diagrams which illustrate the radiating element of a drooping helix antenna in accordance with the present invention corresponding to the elevation views of FIGS. 4 and 5 respectively. As shown in FIG. 4*a* and FIG. 4, each element 42, 44, 46, and 48 of the antenna 40 is attached to a corresponding drooping portion that may comprise a first drooping portion 47 (of length L)

and a second drooping portion 41. It should be noted that the portions 47 and 41 could be adjusted in relative angle and length to suit the particular application. Preferably, the drooping portions 41 and 47 are comprised of rigid wire that can be manipulated into the appropriate angles. (The drooping portions can also be printed on a circuit board). For instance, it may be advantageous in certain instances to have a longer first drooping portion 47 that provides greater performance for receipt of satellite transmissions from positions that reside at higher elevation angles. The angles between the two drooping portions or between a tubular portion 45 and the first drooping portion 47 may also be modified to suit performance and physical constraints as necessary.

As shown in FIG. 5*a* and FIG. 5, each radiating element 42, 44, 46, and 48 of an antenna 50 has a corresponding drooping portion that may comprise a first drooping portion 47 and a second drooping portion 41 as previously shown with respect to FIG. 4. In addition, the embodiment of FIG. 5 also includes radiating portions (42', 44', 46', and 48') that can be folded in a substantially perpendicular relation with a longitudinal axis of the tubular portion 45 (or the radiating elements (42, 44, 46, and 48) themselves and substantially formed along an upper periphery of the tubular portion 45. In other words, each of the plurality of radiating elements further comprise a substantially perpendicular portion each having a distal end that couples to a corresponding member of the plurality of drooping elements as shown in FIG. 5. This results in reduced antenna dimensions in the XY plane. The combination of (folded) radiating portions (42', 44', 46' and 48') and the drooping portions gives an antenna designer added choice in implementing a suitable low profile helix antenna. The drooping portions should be arranged and constructed to be in substantially 90 degrees phase from each adjoining "drooping" branch in a quadrifilar antenna or 120 degrees phase offset in a trifilar antenna (using 3 "drooping" branches) or 180 degrees phase offset in a bifilar antenna (using 2 "drooping" branches). The antenna 50 may also preferably comprise a feed network and coupler as shown in FIG. 3.

Figure 6:
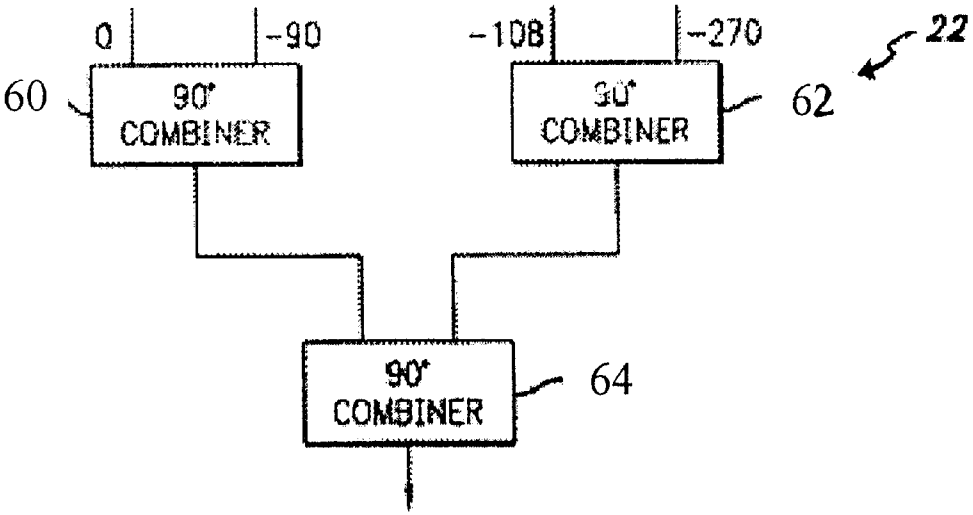
FIG. 6 is a block diagram of the feed network used in connection with the illustrative implementation of the drooping helix antenna of the present invention.

FIG. 6 is a block diagram of the feed network 22 used in connection with the illustrative implementation of the quadrifilar helix antenna of the present invention. In accordance with conventional teachings, the feed network 22 includes first, second and third 90 degree combiners 60, 62, and 64 respectively. First and second inputs to the first combiner 60 are provided by the first and second radiating elements 32 and 34 of the antenna 30 to the present invention. First and second inputs to the second 90 degree combiner 62 are provided by the third and fourth radiating elements 36 and 38 of the antenna 30 of the present invention. The inputs to the first and second combiners 60 and 62 are combined and provided to the third combiner 64, which, in turn, provides a single output for the antenna 30.

The four helices of a quadrifilar antenna are fed with equal amplitude signals. The relative phases of these signals are: 0.degree., −90.degree., −180.degree., −270.degree. The feed network shown in FIGS. 4 and 6 achieves these amplitude and phase requirements.

The novel method of making a quadrifilar helix antenna of the present invention includes the steps of: ascertaining desired antenna characteristics for a given application; ascertaining limitations on antenna height for the application; fabricating a helical antenna in accordance with the desired antenna characteristics; and adjusting the height of the antenna in accordance with the limitations by drooping portions of the radiating elements in extensions of lengths and angles as need and also optionally folding a portion of the radiating elements thereof. The fabrication step might involve the application of conductive (e.g., copper) tape or wire in a spiral or helical fashion to a dielectric tube that is shorter in length than the angled length of the radiating elements. The excess length of each radiating element is then either provided in the drooping element or additionally provided with folds preferably in the manner disclosed herein and illustrated in FIG. 3, 4 or 5 above.

One advantage of the antenna 30, 40 or 50 of the present invention is that antenna height is maintained while impedance matching is achieved by drooping the excess length and/or folding the excess wire of each radiating element back onto itself as shown in FIG. 3 or substantially perpendicular as shown in FIG. 5. For example, one may expect to be able to reduce the height of the antenna 30 by a significant percentage, compared to that of the antenna 10' of FIG. 1 or a large percentage, compared to that of the antenna 10 of FIG. 2, without adversely affecting the gain thereof. Thus, for an antenna operating at an exemplary XM satellite radio frequency of approximately 2.3 GHz, the height of the antenna may be reduced by as much as 50% without adversely affecting the gain.

Thus, the present invention has been described herein with reference to a particular embodiment for a particular application. Those having ordinary skill in the art and access to the present teachings will recognize additional modifications, applications and embodiments within the scope thereof. For example, those skilled in the art will appreciate that although the present invention is illustrated with respect to an application by which the antennas 30, 40 or 50 is used for reception, the antenna may be used for transmission as well. That is, the performance benefits discussed above with respect to radiation in a transmission mode will be understood as relating to sensitivity when implemented in a receiver. In this case, the above-referenced top to bottom ratio of the antenna of the present invention is effective to minimize the interference in the antenna induced by circuitry disposed below the antenna.

Further, the present invention is not limited to use in satellite radio applications. For example, by simply changing the direction of the line means of the radiating elements, the teachings of the present invention may be utilized for GPS applications. Indeed the teachings of the present invention may be utilized for various applications at various frequencies without departing from the scope thereof.

It should also be noted that the teachings of the present invention are not limited to use in connection with quadrifilar helix antennas. The present teachings may be utilized with helical and spiral antennas having any number of radiating elements. It is therefore intended by the appended claims to cover any and all such applications, modifications and embodiments within the scope of the present invention. The description above is intended by way of example only and is not intended to limit the present invention in any way except as set forth in the following claims.

I claim:

1. A drooping helix antenna comprising:

at least first and second radiating elements of conductive material, each element extending in a first direction in a first plane and having a portion thereof drooping in at least a second direction in a second plane;

means for individually feeding at least two of said elements; and means for maintaining said radiating elements in a substantially helical or spiral shape except for said drooping portion.

2. The invention of claim 1 wherein each of said radiating elements has a portion folded into parallel relation with the first direction in a longitudinal axis of said element.

3. The invention of claim 2 wherein said means for individually feeding at least two of said elements further includes a feed network electrically coupled to said radiating elements.

4. The invention of claim 1 wherein said means for maintaining comprises a tube and wherein at least two of said radiating elements have a portion at the distal end thereof folded in a substantially perpendicular relation with a longitudinal axis thereof and substantially formed along an upper periphery of the tube.

5. The invention of claim 1 wherein the antenna further comprises a feed network in a plane substantially perpendicular to the first plane of the radiating elements.

6. The invention of claim 1 wherein the antenna comprises four radiating elements having four corresponding drooping elements and wherein said drooping elements are in a 90 degree phase difference between each feed.

7. The invention of claim 6 wherein said first and second radiating elements are connected at proximal ends thereof to provide a first terminal and said third and fourth radiating elements are connected at proximal ends thereof to provide a second terminal.

8. The invention of claim 7 wherein said means for individually feeding at least two of said elements further includes a 180 degree combiner connected to said first and second terminals.

9. The invention of claim 1, wherein the antenna comprises two radiating elements having two corresponding drooping elements and wherein said drooping elements are in a 180 degree phase difference between each feed.

10. The invention of claim 1, wherein the antenna comprises three radiating elements having two corresponding drooping elements and wherein said drooping elements are in a 120 degree phase difference between each feed.

11. The drooping helix antenna of claim 1, wherein the drooping helix antenna is selected from the group comprising a drooping quadrifilar helix antenna, a drooping bifilar helix antenna, or a drooping trifilar helix antenna.

12. The drooping helix antenna of claim 1, wherein the portion thereof drooping a second direction comprises a first drooping member protruding substantially perpendicular from the first plane and further comprising a second drooping member substantially perpendicular from a plane where the first drooping member resides.

13. A drooping quadrifilar helix antenna comprising:

first, second, third, and fourth radiating elements of conductive material, each element extending in a first direction in a first plane and at least one of the radiating elements having a portion thereof drooping in a second direction in a second plane;

a dielectric tube for maintaining a substantial portion of said radiating elements in a substantially helical or spiral shape; and a coupler for coupling electrical energy to and/or from each of said was radiating elements, wherein said coupler includes a feed network for individually feeding at least two of said elements.

14. The drooping quadrifilar helix antenna of claim 13, wherein each of the radiating elements has a portion thereof folded in a direction being substantially parallel to a longitudinal axis of said radiating element.

15. The drooping quadrifilar helix antenna of claim 13, wherein the antenna is tuned to receive signals selected from the group of global positioning satellite signals, Satellite Digital Audio Radio System (SDARS) signals, or other suitable satellite signals.

16. The invention of claim 13, wherein said means for individually feeding at least two of said elements further comprises a feed network electrically coupled to said radiating elements.

17. The drooping helix antenna of claim 13, wherein the portion thereof drooping a second direction comprises a first drooping member protruding substantially perpendicular from the first plane and further comprising a second drooping member substantially perpendicular from a plane where the first drooping member resides.

18. A drooping helix antenna, comprising:

a plurality of radiating elements each formed in a substantially parallel spiral configuration;

a plurality of drooping elements appended to a corresponding member of the plurality of radiating elements, wherein at least a portion of each of the plurality of drooping elements are in a substantial perpendicular relation to the corresponding member of the plurality of radiating elements.

19. The drooping helix antenna of claim 18, wherein the drooping helix antenna further comprises a feed network coupled to the plurality of radiating elements and formed substantially perpendicular thereto.

20. The drooping helix antenna of claim 18, wherein each of the plurality of radiating elements further comprise a substantially perpendicular portion each having a distal end that couples to a corresponding member of the plurality of drooping elements.

* * * * *